United States Patent [19]

Lockwood et al.

[11] 3,963,413

[45] June 15, 1976

[54] CIGARETTE LIGHTER HAVING IMPROVED VALVE MEANS

[75] Inventors: John C. Lockwood, Atlanta; Harry L. Vaughan, Lawrenceville, both of Ga.

[73] Assignee: Scripto, Inc., Atlanta, Ga.

[22] Filed: Aug. 19, 1974

[21] Appl. No.: 498,457

[52] U.S. Cl. ..... 431/276; 431/254; 431/344

[51] Int. Cl.[2] ..... F23Q 2/16

[58] Field of Search ..... 431/130, 131, 142, 143, 431/150, 254, 276, 277, 344; 222/3; 251/339

[56] References Cited

UNITED STATES PATENTS

| | | | |
|---|---|---|---|
| 2,616,161 | 11/1952 | Reilly | 431/344 |
| 3,055,201 | 9/1962 | Smith | 431/150 |
| 3,228,215 | 1/1966 | Racek | 431/143 |
| 3,439,994 | 4/1969 | Cassan | 431/254 |
| 3,678,695 | 7/1972 | Lambert | 431/344 |
| 3,867,090 | 2/1975 | Gili | 431/254 |

*Primary Examiner*—Carroll B. Dority, Jr.
*Attorney, Agent, or Firm*—Newton, Hopkins & Ormsby

[57] ABSTRACT

A cigarette lighter is disclosed having a body defining a fuel reservoir and a passageway extending from the reservoir to the body exterior. An elongated sleeve is disposed within the passageway having interior walls defining a bore and a longitudinal groove in the walls opening to the bore. A solid valve stem is movably disposed within the sleeve bore. Actuation means are provided for moving the valve stem within the bore to effect valve operations.

5 Claims, 3 Drawing Figures

CIGARETTE LIGHTER HAVING IMPROVED VALVE MEANS

BACKGROUND OF THE INVENTION

This invention relates generally to cigarette lighters, and particularly to improvements in valve means for relatively simple and inexpensive cigarette lighters such as those of the "throw-away" type.

There exist today cigarette lighters of such inexpensive construction that they are purposely designed to be discarded upon consumption of fuel initially disposed therein during manufacture. These lighters typically comprise a body which defines a fuel reservoir and a passageway communicating between the reservoir and an exterior surface of the body. Valve means are disposed within the passageway. A spindle or insert is threaded within the passageway to establish a valve opening. A hollow valve stem is then movably disposed within the spindle to effect valve operations, through which stem fuel vapors pass to the exterior of the body upon movement of the valve stem by associated actuation means.

Insomuch as cigarette lighters of the type just described are designed to be discarded upon consumption of a single fuel filling, it is commercially compelling that every effort be made to minimize all elements of cost in both parts and in assembly labor. That both the spindle and valve stem of prior art lighters have been machine formed and threaded has proven relatively costly, particularly when compared with alternative modes of manufacture such as punch pressing and the like. The valve actuating means has typically included a lever which has had to be held to the lighter body by ancillary fastening means. If a lighter could be devised in which one or more of these components could be simply formed such as with punch press techniques instead of machines a significant advance in the art would be achieved.

Accordingly, it is a general object of the present invention to provide a cigarette lighter having improved valve means.

More specifically, it is an object of the present invention to provide a cigarette lighter having a relatively simple and inexpensive valve component, parts of which may be punch pressed instead of machined.

Yet another object of the invention is to provide a cigarette lighter having a valve which may be expeditiously assembled and secured in place with minimum use of independent fasteners.

SUMMARY OF THE INVENTION

In one form of the invention a cigarette lighter is provided comprising a body which defines a fuel reservoir and a passageway extending from the reservoir to the body exterior. An elongated sleeve is disposed within the passageway having internal walls defining a bore with a longitudinal groove in the walls opening to the bore. A solid valve stem is movably disposed within the sleeve bore. Actuation means are provided for moving the valve stem within the bore to effect valve operations.

In another form of the invention a cigarette lighter is provided comprising a body defining a fuel reservoir and a passageway extending from the reservoir to an orifice in an exterior surface of the body with the passageway including a cylindrical channel communicating with the orifice. A cylindrical sleeve having an elongated groove extending along an interior surface thereof is disposed within the cylindrical channel with a sleeve flange secured to the body exterior surface about the orifice. A solid cylindrical valve stem is movably disposed within the cylindrical sleeve adjacent the groove and resilient sealing means disposed within the passageway adjacent an end of the cylindrical valve stem. Actuation means are provided for moving the valve stem and sealing means within the passageway to effect a valve operation and thereby control the flow of fuel within the elongated groove. Alternatively, the groove may be disposed in the exterior surface of stem and the interior surface of the sleeve being of interrupted circular configuration.

DETAILED DESCRIPTION OF THE DRAWING

Figure 1:
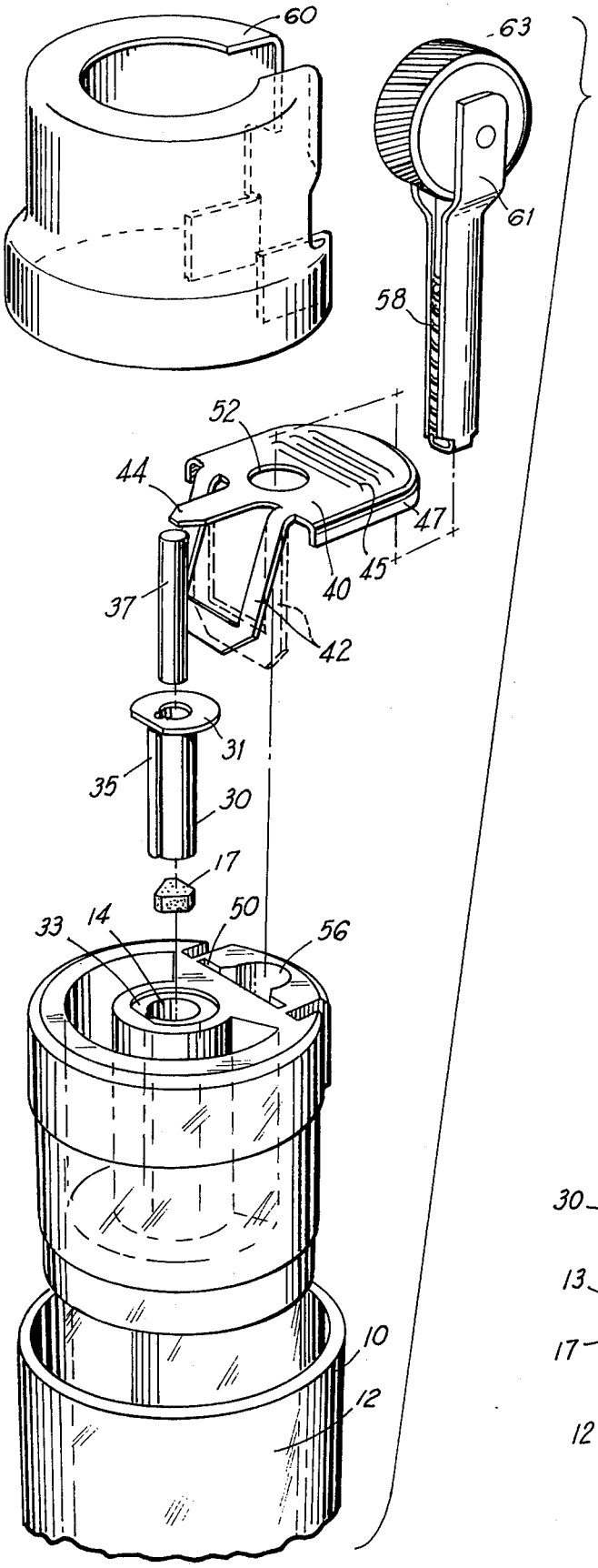
FIG. 1 is an exploded view in perspective of a cigarette lighter embodying principles of the invention in one preferred form.
Figure 2:
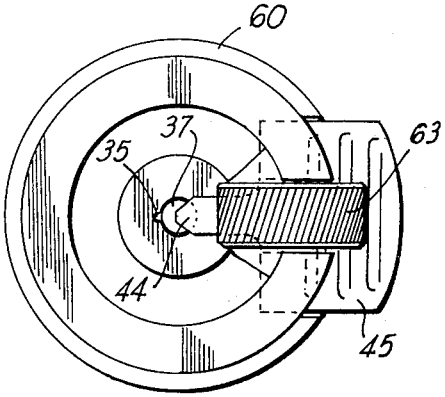
FIG. 2 is an assembled plan view of the lighter illustrated in FIG. 1.
Figure 3:
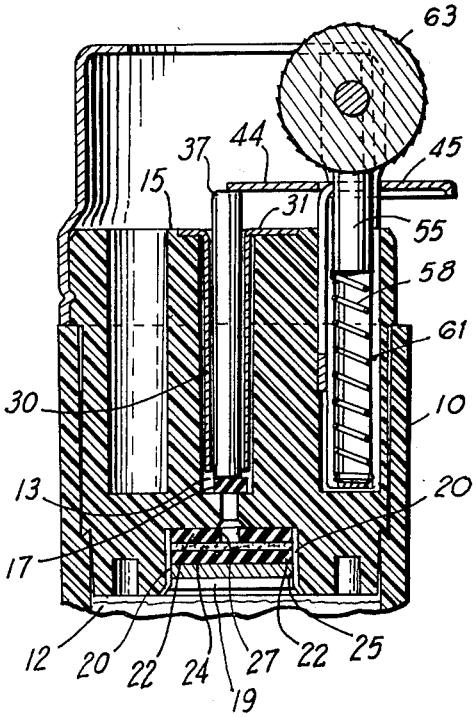
FIG. 3 is a cross-sectional view of an upper assembled portion of the lighter depicted in FIG. 1.

Referring now in more detail to the drawing, there is illustrated a cigarette lighter having a generally cylindrical housing body 10 defining a reservoir 12 and a passageway 13 communicating between the reservoir and a recess 14 in an exterior end surface 15 of the body. Passageway 13 includes a cylindrical channel portion having a lower step upon which a resilient, generally triangular shut-off washer 17 is disposed, and an enlarged lower channel 19 having four angularly spaced grooves 20 therein. A fluid regulator is seated within the lower channel which is seen to include two rubber disks 22 sandwiched about a filter disk 24, and a metal disk 25 firmly supporting the rubber disks and filter disk within an upper end portion of the lower channel. With this arrangement the lower metal disk directs fuel to pass upwardly from reservoir 12 through grooves 20 and then radially through the disk filter prior to rising through a central hole 27 in the uppermost rubber disk 22 towards shut-off washer 17. Reservoir 12 itself is filled with foam thoroughly soaked with fuel such as butane. Most of the fuel is maintained in a liquid state here due to the elevated pressure within the reservoir normally sealed off from ambient atmosphere.

A generally tubular insert 30 is seated within recess 14 with an upper flange portion 31 thereof seated within a recess 33. This seating prevents vapors within the upper channel from passing about the outside of the insert to ambient atmosphere. Insert 30 has interior walls defining a generally cylindrical bore and a longitudinal groove 35 extending along and opening to the bore defining interior walls. A solid, cylindrical valve stem 37 is movably disposed within the insert. The valve stem is preferably formed of a simple length of brass wire and is dimensioned to fit snugly but movably within the insert bore adjacent but outside the bounds of longitudinal groove 35.

A valve actuating member is provided comprising a unitary lever 40 formed from a steel blank. The lever includes two legs 42 which straddle a tongue 44, and a thumb engaging section 45 made relatively rigid by a stiffening rim 47. The lever is formed with legs 42 bent downwardly at an angle of some 70° with respect to projecting tongue 44. During assembly the legs are press-fitted into a slot 50 within body 10 bringing tongue 44 into engagement with the top of valve stem 37. Once seated within slot 50 legs 42 are disposed at substantially a right angle with respect to tongue 44. Being resilient this spreading from the 70° angle formed during manufacture to a 90° angle creates a downward spring bias exerted by tongue 44 upon the valve stem.

Thumb engaging section 45 of the actuating member has a central aperture 52 through which a hollow spark wheel carrier 61 projects from a cylindrical channel 56 in body 10 which channel opens to slot 50. A flint 55 and spring 58 are disposed within the carrier 61 which carrier supports a rotatable spark wheel 63 above the actuation member adjacent orifice. A tubular wind guard or cap 60 is secured to an upper portion of body 10 about the protruding end of valve stem 37.

We thus see that a cigarette lighter is provided having inexpensive valve means including an insert which may be press punched, a valve stem which may be formed as a mere length of wire, and a valve actuating member formed from a unitary metallic blank which may be secured to the lighter body without need for auxiliary fastening means.

In operation tongue 44 of the valve actuating member normally exerts a downward bias upon valve stem 37 urging it into engagement with shut-off washer 17 to seal reservoir 12 and the fuel regulator from ambient atmosphere. A pressure differential will accordingly exist between the reservoir and ambient atmosphere as fuel is vaporized in the confined chamber. To create a flame the thumb engaging portion 45 of the lever is depressed causing tongue 44 to rise which permits the pressure within the reservoir to urge shut-off washer 17 and valve stem 37 upwardly thereby exposing the fuel regulator to ambient atmosphere. Vapor may then progress up through groove 35 from the regulator about the far side of valve stem 37 from spark wheel 63, and then out the open top of wind guard 60. That groove 35 is positioned about the opposite side of the valve stem from the flint wheel carrier inhibits any portion of the gas stream from passing underneath the flint wheel and actuating lever. Rotation of flint wheel

60 in engagement with flint 55, which actions may be performed simultaneously with the depression of the valve actuating lever, generates a spark which ignites the fuel causing the stream of gas to flame.

It should be understood that the just described embodiment merely illustrates principles of the invention in one preferred form. Many modifications may, of course, be made to this specifically described embodiment without departure from the spirit and scope of the invention as set forth in the following claims:

What is claimed is:

1. A cigarette lighter comprising a body defining a fuel reservoir and a passage way extending from the reservoir to the body exterior said passageway having a stepped inner portion; an elongated sleeve disposed within said passageway being sealed to said body and having a groove extending its length; a solid valve stem movably disposed within said sleeve; resilient sealing means between said valve stem and stepped portion of said passageway for contacting said valve stem and said stepped portion of said passageway for controlling the flow of fuel; and actuation means for allowing varied positioning of said valve stem within said sleeve to control the flow of fuel between the reservoir and body exterior so that said fuel flow is directed adjacent said actuation means.

2. A cigarette lighter in accordance with claim 1 wherein said sleeve is substantially cylindrical, and wherein said solid valve stem is substantially cylindrical.

3. A cigarette lighter in accordance with claim 1 wherein said actuation means comprises a lever mounted to said body in spring biased engagement with an end of said solid valve stem protruding out of said elongated sleeve.

4. A cigarette lighter in accordance with claim 3 wherein said body defines a slot into which a portion of said lever is press-fitted.

5. A cigarette lighter in accordance with claim 4 wherein said body defines an elongated cavity communicating with said slot in which cavity a flint and spring are disposed.

* * * * *